US011317737B2

(12) United States Patent
Berglund et al.

(10) Patent No.: US 11,317,737 B2
(45) Date of Patent: May 3, 2022

(54) MERCHANDISING TRAY SYSTEM

(71) Applicant: Process Retail Group, New Berlin, WI (US)

(72) Inventors: Terrence G. Berglund, Hales COrners, WI (US); James P. Ihrcke, West Allis, WI (US); Christopher A. Harrell, Wauwatosa, WI (US)

(73) Assignee: Process Retail Group, Inc., New Berlin, WI (US)

( * ) Notice: Subject to any disclaimer, the term of this patent is extended or adjusted under 35 U.S.C. 154(b) by 0 days.

(21) Appl. No.: 17/109,874

(22) Filed: Dec. 2, 2020

(65) Prior Publication Data

US 2021/0161310 A1 Jun. 3, 2021

Related U.S. Application Data

(60) Provisional application No. 62/942,635, filed on Dec. 2, 2019.

(51) Int. Cl.
*A47F 1/12* (2006.01)
*A47F 7/00* (2006.01)

(52) U.S. Cl.
CPC ..... *A47F 1/126* (2013.01); *A47F 7/0007* (2013.01)

(58) Field of Classification Search
CPC ..... A47F 1/126; A47F 7/0007; A47F 5/0025; A47B 57/58; A47B 96/025
See application file for complete search history.

(56) References Cited

U.S. PATENT DOCUMENTS 2,139,520 A * 12/1938 Sol Scheinman ..... B42F 17/02 312/261
4,907,707 A * 3/1990 Crum ..... A47F 1/126 206/556
5,012,936 A * 5/1991 Crum ..... A47F 1/126 206/556
5,123,546 A * 6/1992 Crum ..... A47F 1/126 206/556
5,855,283 A 1/1999 Johnson
7,168,579 B2 1/2007 Richter
7,690,519 B2 * 4/2010 Kahl ..... A47F 5/0093 211/59.2
8,453,851 B2 * 6/2013 Ciesick ..... A47F 1/126 211/59.3
9,101,230 B2 * 8/2015 Sosso ..... A47F 5/0018
9,131,787 B2 9/2015 Berglund
(Continued)

FOREIGN PATENT DOCUMENTS

FR 2542591 A1 * 9/1984 ..... A47F 1/126
WO WO-0143598 A1 * 6/2001 ..... A47F 1/126
WO WO-2019236860 A1 * 12/2019 ..... A47B 57/58

*Primary Examiner* — Stanton L Krycinski
(74) *Attorney, Agent, or Firm* — Christopher M. Scherer; DeWitt LLP

(57) ABSTRACT

The present invention is merchandising tray system. Within the system, a tray top plate is slidably mounted to a tray base plate, allowing the tray top plate to be extended beyond the edge of the shelf to which the system is mounted. A plurality of sidewalls are removably mounted to the tray top plate, allowing controlled expansion and contraction of the width of the system supporting products. A support arm is slidably extendable from the tray base plate, allowing the system to be mounted along any depth of the shelf.

19 Claims, 10 Drawing Sheets

(56) References Cited

U.S. PATENT DOCUMENTS

| | | | | |
|---|---|---|---|---|
| 9,138,076 | B2 * | 9/2015 | Hardy | A47F 5/005 |
| 9,445,675 | B1 * | 9/2016 | DeSena | A47F 5/005 |
| 9,629,480 | B2 * | 4/2017 | Ewing | A47F 1/128 |
| 9,642,475 | B2 * | 5/2017 | Vogler | A47F 1/12 |
| 9,713,394 | B1 * | 7/2017 | Bruegmann | A47F 5/0025 |
| 10,251,494 | B1 * | 4/2019 | Nagel | A47F 5/005 |
| 10,786,094 | B2 * | 9/2020 | Bruegmann | A47F 5/005 |
| 10,912,398 | B2 * | 2/2021 | Wills | A47F 5/005 |
| 10,952,548 | B2 * | 3/2021 | Pollpeter | A47F 3/001 |
| 10,959,543 | B2 * | 3/2021 | Wills | A47F 1/125 |
| 11,064,817 | B2 * | 7/2021 | Turner | A47F 1/125 |
| 2003/0085187 | A1 | 5/2003 | Johnson | |
| 2003/0217980 | A1 | 11/2003 | Johnson | |
| 2009/0039040 | A1 * | 2/2009 | Johnson | A47F 5/0025<br>211/120 |
| 2010/0107670 | A1 * | 5/2010 | Kottke | A47F 3/14<br>62/250 |
| 2017/0202369 | A1 * | 7/2017 | Mercier | G01B 21/16 |
| 2018/0035825 | A1 * | 2/2018 | Pollpeter | A47F 7/0014 |
| 2020/0015601 | A1 * | 1/2020 | Padvoiskis | A47F 1/12 |

* cited by examiner

FIG. 1b
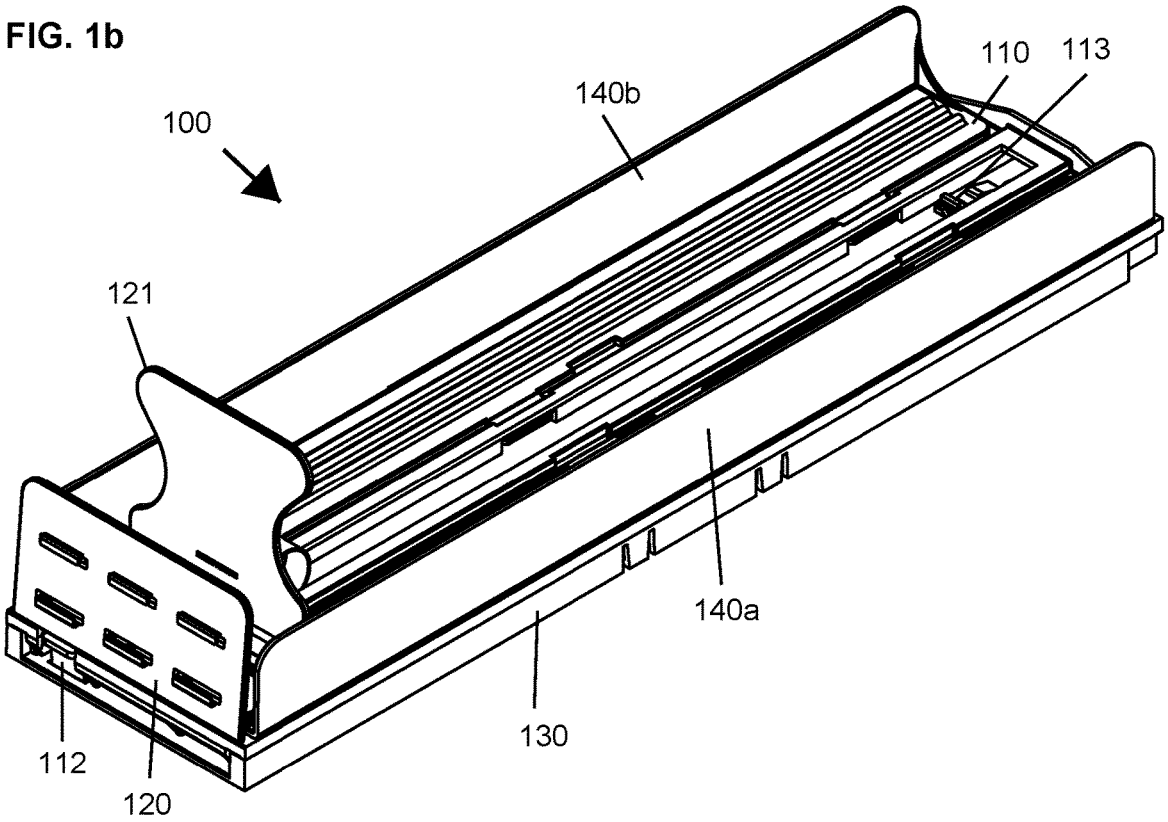
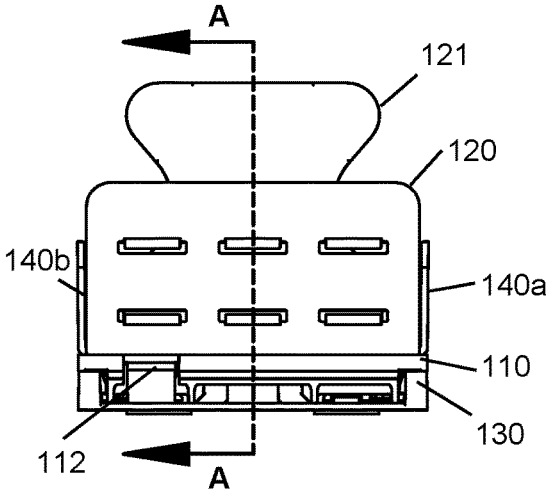
FIG. 1c
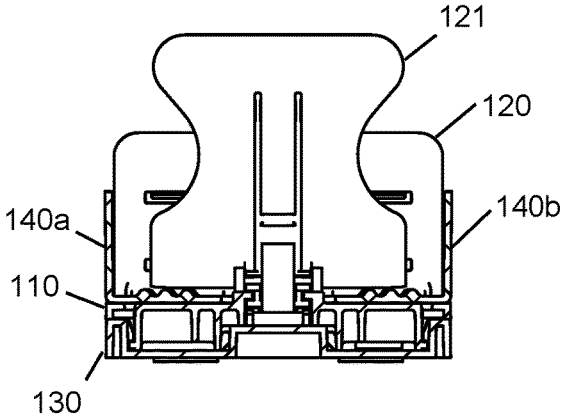
FIG. 1d

MERCHANDISING TRAY SYSTEM

CROSS-REFERENCE TO RELATED APPLICATIONS

This application claims the benefit of prior-filed, co-pending U.S. Provisional Patent Application No. 62/942,635, filed on Dec. 2, 2019, the contents of which are incorporated herein by reference in their entirety.

BACKGROUND OF THE INVENTION

1. Field of the Invention

The present invention relates to a store display, more specifically an expandable shelf tray for holding merchandise.

2. Background

Many retail stores rely on merchandising tray systems known as tray pushers to ensure that merchandise is automatically located on the front of shelves, within easy reach of customers. However, because merchandise does not have standard dimensions, most tray pushers must be specifically sized to the merchandise carried or risk jamming the tray pusher. Furthermore, because the shelving to which the pushers are affixed also have varying dimensions, the tray pushers may not be able to completely fill the shelves, may be too far back from the shelf front edge, or may protrude from the shelves.

This is of particular concern in refrigerated or frozen cases, where unused space results in wasted energy, and where protruding tray pushers may damage unit doors or prevent them from closing. Tray pushers located too far back from the shelf front edge are difficult to restock and do not provide proper presentation of merchandising. This may lead to store employees failing to properly anchor the tray pusher in place so as to move it forward to the shelf front edge, which can be a safety hazard.

Adjustably-sized tray pushers may be complex, with convoluted adjustment means that add time and cost to shelf installation and product stocking. Retail stores are reducing staff and major consumer packaged goods (CPG) brands are eliminating field staff. This results in fewer retail workers available for installation of tray pushers and fewer CPG workers who carry and know how to use the tools required for installation of most tray pushers in retail stores. The overall reduction of labor, and elimination of experienced installation staff, has created a situation where a required tool, like a hand tool such as a screwdriver, can limit the ability to implement a tray pusher display program.

Accordingly, there is a need in the art for a merchandising tray system which can be easily adjusted to accommodate multiple sizes of merchandise and shelves, and can be installed without the use of hand tools.

BRIEF SUMMARY

The present invention is merchandising tray system. Within the system, a tray top plate is slidably mounted to a tray base plate. A plurality of sidewalls are removably mounted to the tray top plate. A support arm is slidably extendable from the tray base plate. An arm lock is configured to move at least one structure of the tray base plate into an interlocking relationship with a structure of the support arm, such that when the arm lock is actuated, the support arm is locked into position relative to the tray base plate.

BRIEF DESCRIPTION OF THE DRAWINGS

FIGS. 1*a*, 1*b*, 1*c*, 1*d*, 1*e*, 1*f*, and 1*g* illustrate exploded perspective, perspective, front, rear, top, right side, and bottom views, respectively, of an exemplary embodiment of a merchandising tray system.

DETAILED DESCRIPTION OF THE INVENTION

Figure 1A:
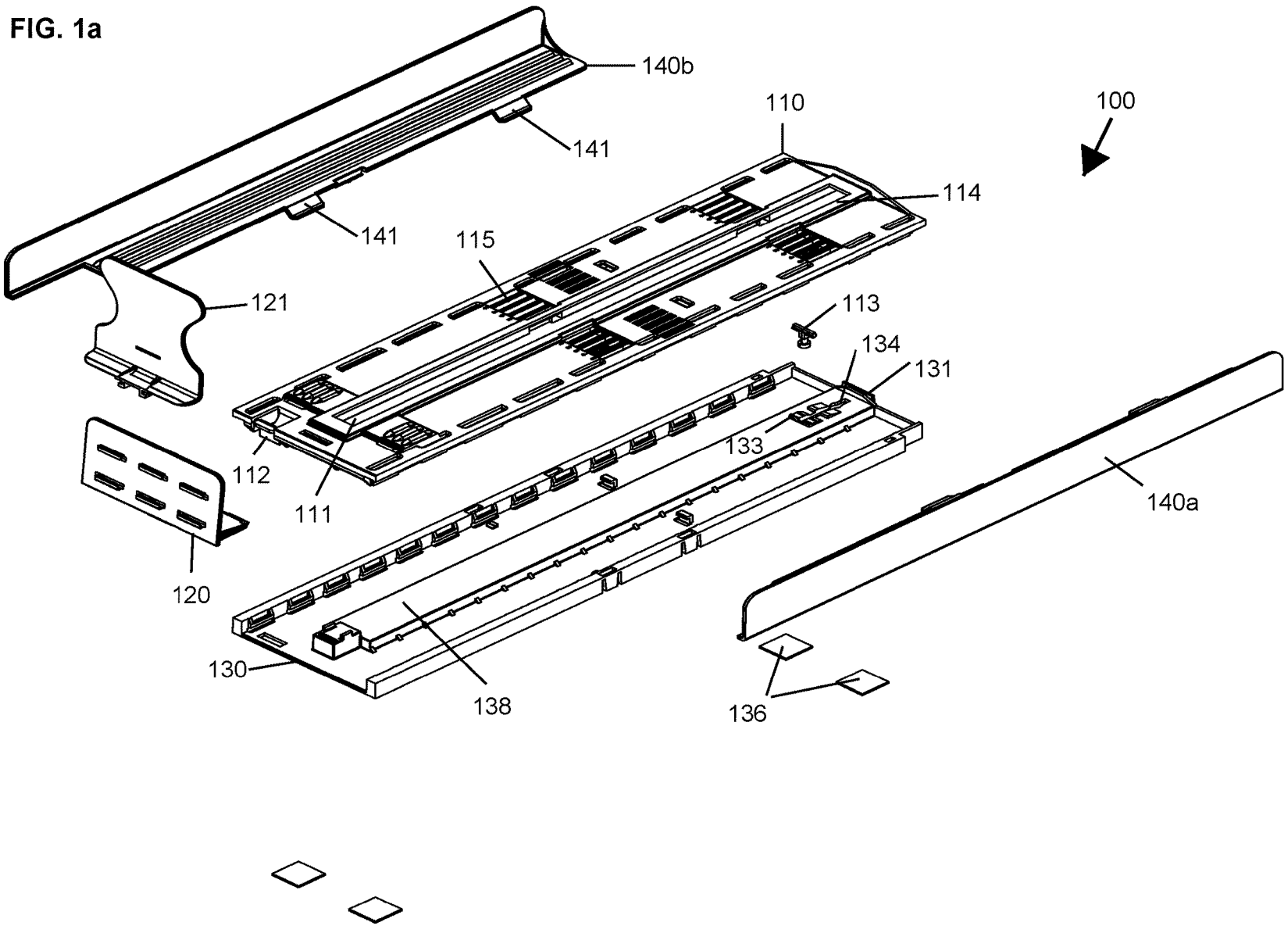
Figure 1E:
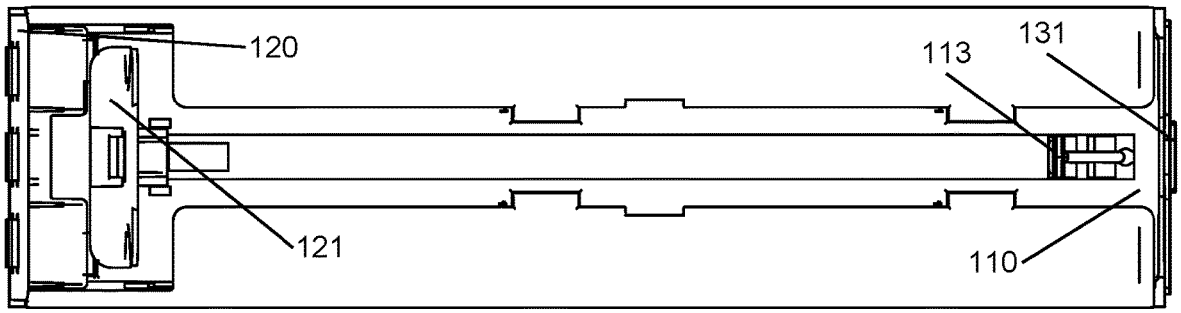
Figure 1F:
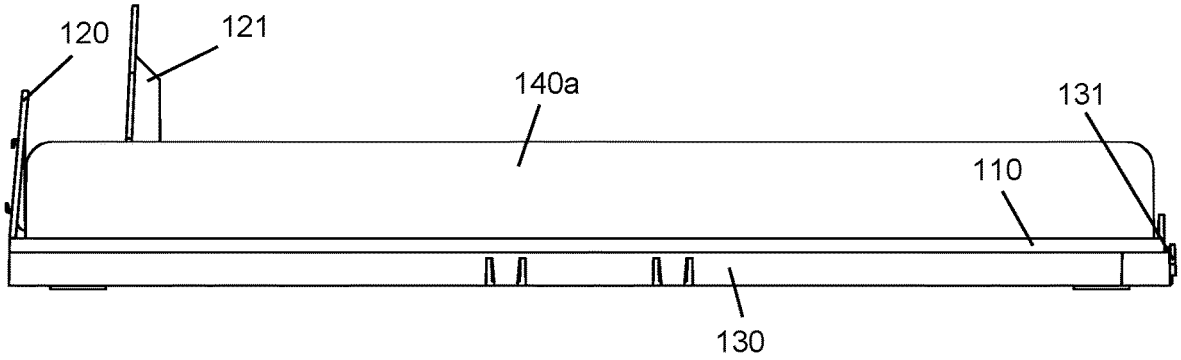
Figure 1G:
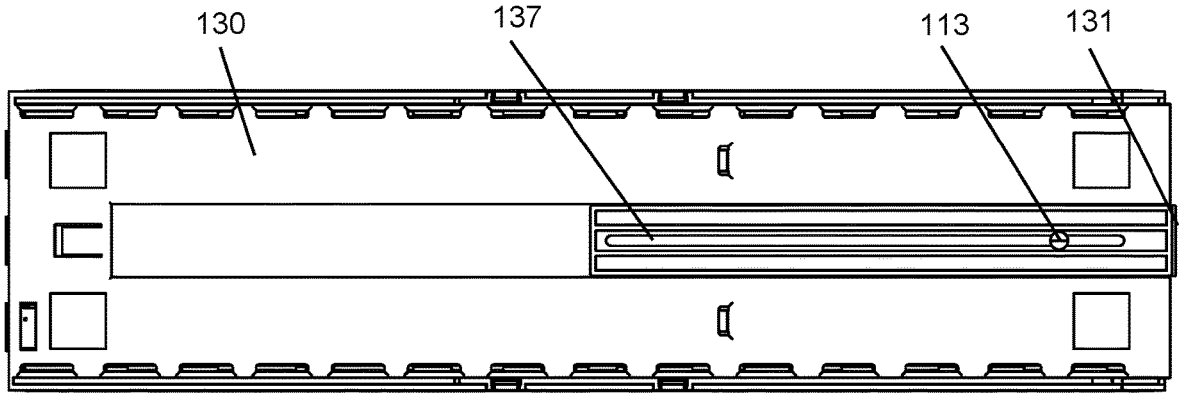
Figure 2A:
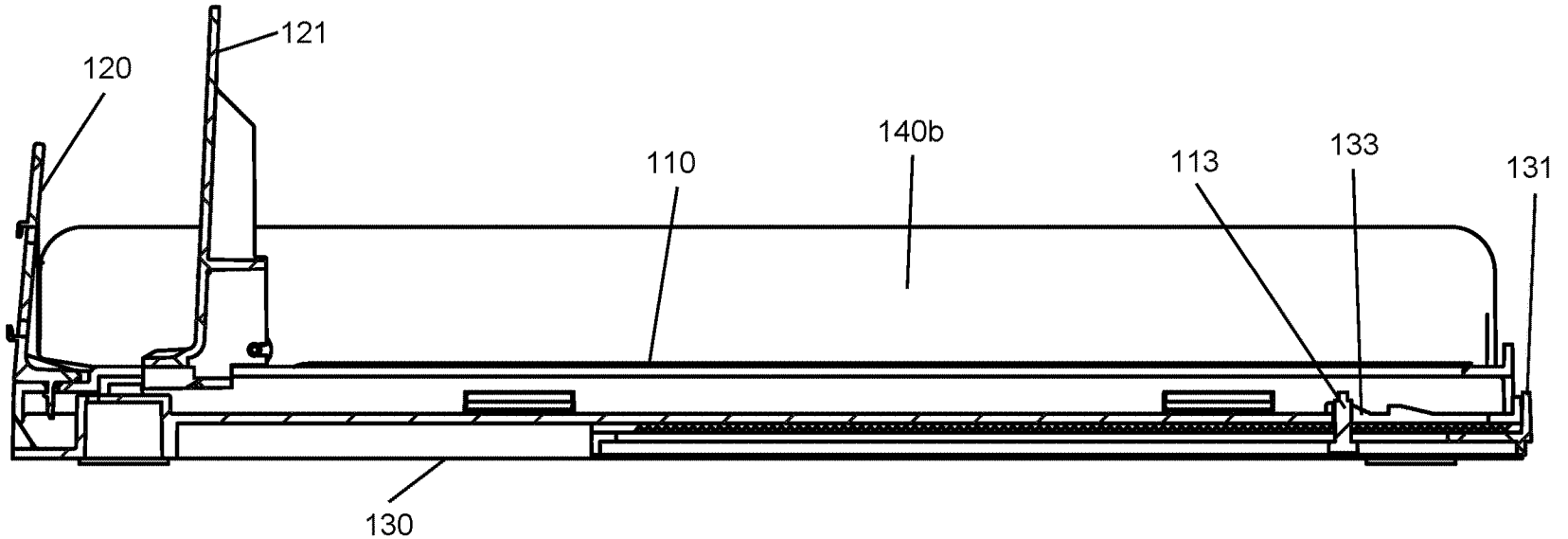
FIG. 2*a* illustrates a cross-sectional view of the merchandising tray system taken from the A-A segment of FIG. 1*c*.
Figure 2B:
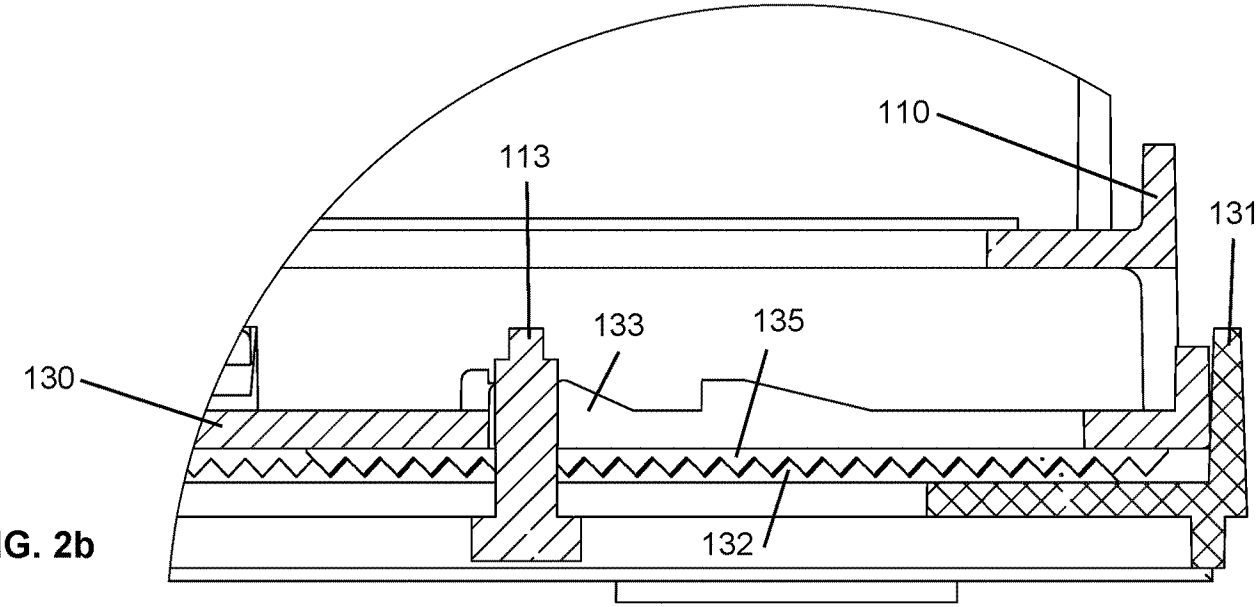
FIG. 2*b* illustrates an enlarged segment of FIG. 2*a*.
Figure 2C:
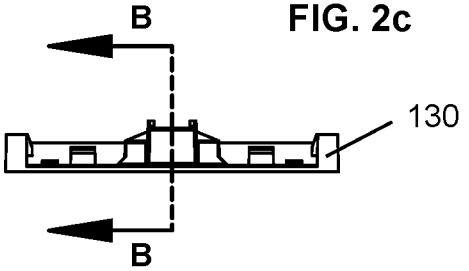
FIG. 2*c* illustrates a front view of a tray base plate of an exemplary embodiment of a merchandising tray system.
Figure 2D:
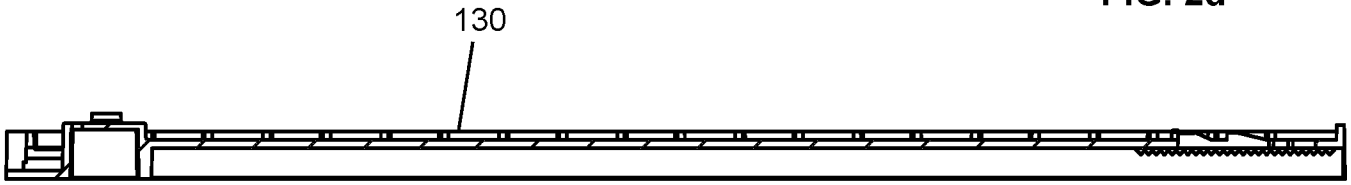
FIG. 2*d* illustrates a cross-sectional view of the tray base plate taken from the B-B segment of FIG. 2*c*.
Figure 2E:
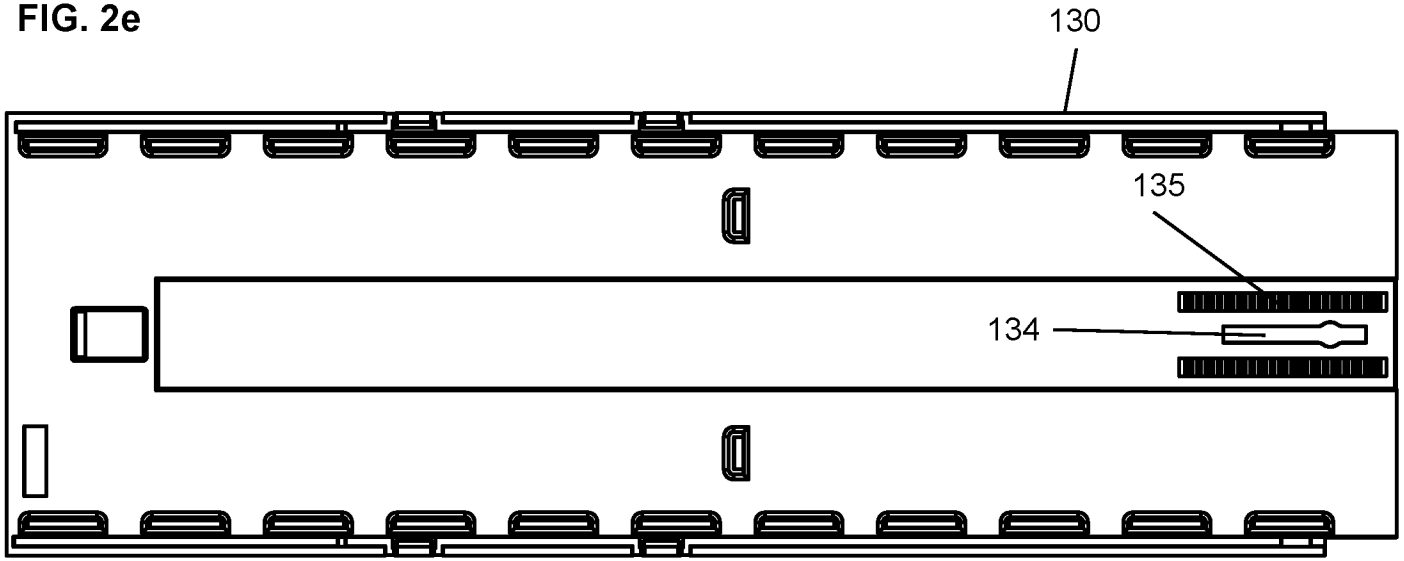
FIG. 2*e* illustrates a bottom view of the tray base plate of an exemplary embodiment of a merchandising tray system.
Figure 2F:
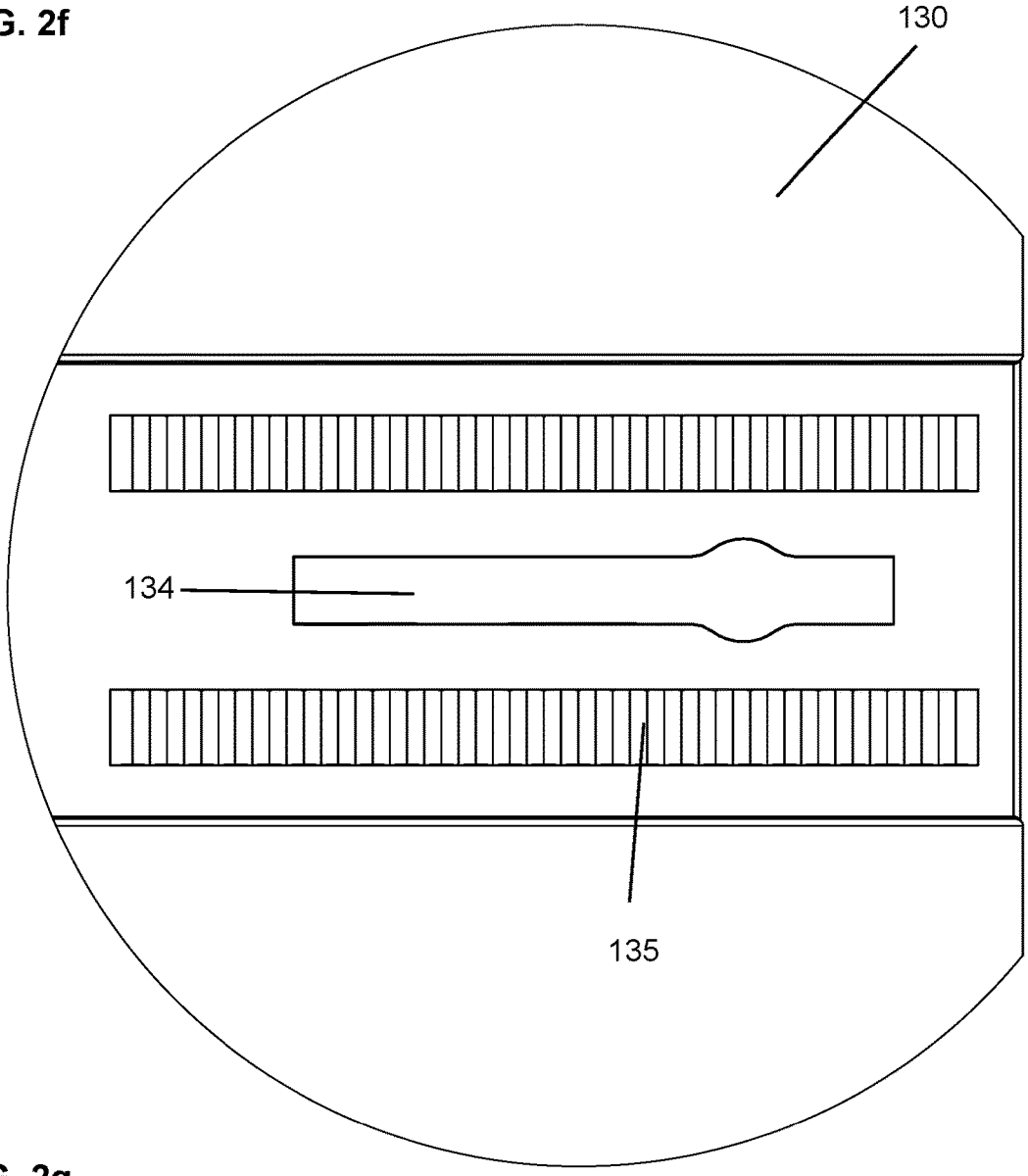
FIG. 2*f* illustrates an enlarged segment of FIG. 2*e*.
Figure 2G:
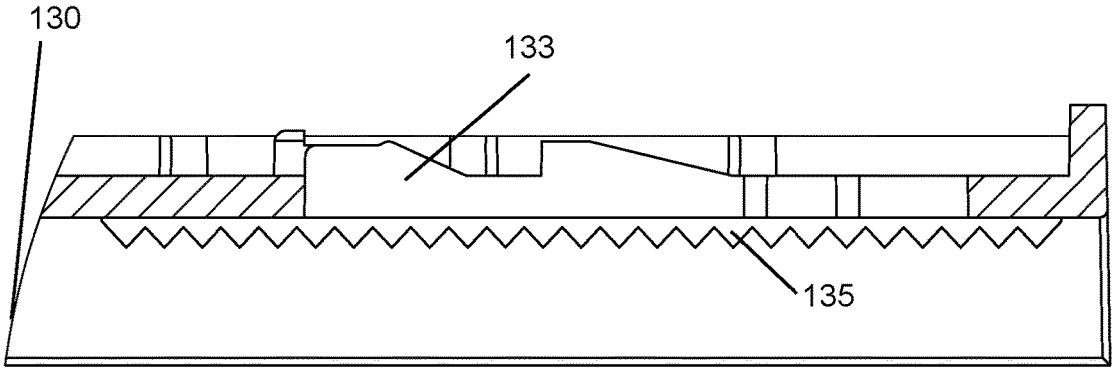
FIG. 2*g* illustrates an enlarged segment of FIG. 2*d*.

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. § 112, sixth paragraph, only if the terms "means for" or "step for" are explicitly recited in the respective limitation.

The merchandising tray system 100 may be removably mounted to a shelf S. The merchandising tray system 100 includes a tray top plate 110 supporting a fixed front wall stop 120 and a slidable merchandising pusher 121. In use, merchandise (not shown) may be biased forward by the merchandising pusher 121 until stopped against the front wall stop 120. The tray top plate 110 may be slidably mounted to a tray base plate 130. In use, the tray top plate 110 may slide along tray base plate 130, extending beyond the front of the shelf S for ease of restocking the merchandising tray system 100. Right and left sidewalls 140*a* and 140*b* can be removably and adjustably mounted to either side of the tray top plate 110. In use, merchandise may be enclosed between the right and left sidewalls 140*a* and 140*b*.

The tray top plate 110 includes a pusher track 111 along an upper surface of the tray top plate 110. The pusher track 111 guides the sliding movement of the merchandising pusher 121. The merchandising pusher 121 may be biased or moved in a forward direction along the pusher track 121 by any movement or biasing mechanism known in the art.

The tray top plate 110 may also include a tray lock 112. The tray lock 112 may be located at a forward surface of the tray top plate 110. Actuation of the tray lock 112 disengages the tray lock 112 from the tray base plate 130 to allow the tray top plate 110 to slide forward and backward on the tray base plate 130. This allows the tray top plate 110 to extend beyond the front of shelf S for merchandising restocking. The tray lock 112 may be biased to return to a locked position when the tray top plate 110 is pushed completely back along tray base plate 130. In the exemplary embodiment, the tray lock 112 is located at a front lower left corner of the merchandising tray system 100.

An arm lock 113 may be accessible through an arm lock aperture 114 extending through a top surface of the tray top plate 110. The arm lock aperture 114 may be located towards the rear of the tray top plate 110. In certain embodiments, the arm lock 113 may also be accessible by extending the tray top plate 110 relative to the tray base plate 130. Actuation of the arm lock 113 can allow a support arm 131 to slidably extend forward and backward from the tray base plate 130. In certain embodiments, the arm lock 113 may be a push-button-type lock. The back end of support arm 131 may be connected to a shelf anchor A known in the art to anchor the merchandising tray system 100 in place. At least one foam pad 136 may be attached to a bottom surface of the tray base plate 130 to increase friction between the shelf S and the tray base plate 130, and to provide some cushioning of merchandising tray system 100.

As shelves may have varying depths, extension and retraction of the support arm 131 allows adjustment of the position of the merchandising tray system 100. By way of non-limiting example, adjustment may keep the fixed front wall stop 120 flush with or a given distance from the front of the shelf S, while still allowing the merchandising tray system 100 to be securely anchored to the back of the shelf S, regardless of the depth of the shelf S. The arm lock 113 also allows the retailer or user to adjust the fit of the merchandising tray system 100 without needing tools. The arm lock 113 also makes it possible for the retailer or user to install the merchandising tray system 100 without requiring hand tools or the skill to use hand tools. Any element required to install, adjust, and operate the merchandising tray system 100 is provided as a part of the merchandising tray system 100.

The arm lock 113 extends through tray base plate 130 and interacts with at least one structure on or in the tray base plate 130. This interaction causes at least one structure of the tray base plate 130 to interact with a surface of the support arm 131 in an interlocking fashion, preventing movement of the support arm 131. When the arm lock 113 is in a locked position, the tray base plate 130 interconnects with the support arm 131, and the support arm 131 cannot be extended or retracted. When the arm lock 113 is in an unlocked position, the tray base plate 130 disengages from the support arm 131, and the support arm 131 can be extended or retracted from an arm channel 138. In the exemplary embodiment, pushing the arm lock 113 back unlocks the support arm 131 and pushing the arm lock 113 forward locks the support arm 131, though the reverse is also contemplated.

In the exemplary embodiment, the arm lock 113 is an I-shaped lock sliding along at least one lock ramp 133 on tray base plate 130. The lower arm of the arm lock 113 prevents the arm lock 113 from being removed from a locking channel 134 in the tray base plate 130 during normal use. The middle arm of the arm lock 113 extends through a tray locking channel 134 in the tray base plate 130 and an arm locking channel 137 in the support arm 131. The upper arm of the arm lock 113 slides along an upper surface of the tray base plate 130.

In the exemplary embodiment, the lock ramp 133 is configured such that moving the arm lock 113 forward raises the arm lock 113 up into contact with the support arm 131, keeping the support arm 131 locked in contact with the tray base plate 130. Moving the arm lock 113 back lowers the arm lock 113 along the lock ramp 133, allowing the support arm 131 to move relative to the tray base plate 130. In the exemplary embodiment, a plurality of base plate teeth 135 located below the lock ramp 133 interlock or mesh with a plurality of support arm teeth 132, which may be located on an upper surface of the support arm 131. It is to be understood that other structures may be used, such as, but not limited to, apertures in the support arm 131 for receiving a corresponding structure from the tray base plate 130 or vice versa. In the exemplary embodiment, the lock ramp 133, the tray locking channel 134, and/or the base plate teeth 135 are connected to and/or extend through arm channel 138.

The right and left sidewalls 140*a* and 140*b* can be removably and adjustably mounted to either side of the tray top plate 110 to accommodate a broad range of merchandising widths. The right sidewall 140*a* is an L-shaped sidewall. At least one connecting tab 141 extends at an angle from the lower leg of the right sidewall 140*a*. The connecting tab 141 interlocks with at least one connecting slot 115 on an upper surface of the tray top plate 110. In embodiments with more than one connecting slot 115 spaced laterally on the tray top plate 110, the right sidewall 140*a* may be placed in multiple lateral positions to accommodate different merchandising widths. In such an embodiment, indicia may be added on the tray top plate 110 to indicate particular widths resulting from use of a particular connecting slot 115. The left sidewall 140*b* is identical in form and function to the right sidewall 140*a*, save for a necessarily mirrored configuration. The discrete spacing of connecting slots 115 allows for adjustability to specific spacings of right and left sidewalls 140*a* and 140*b* without allowing sliding adjustment of right and left sidewalls 140*a* and 140*b*, preventing accidental adjustment of the sidewall spacing. Such accidental adjustment can narrow the spacing and cause product to bind and not advance forward in the merchandising tray system 100 or expand the spacing and cause product to become jammed and/or disorganized.

Figure 3B:
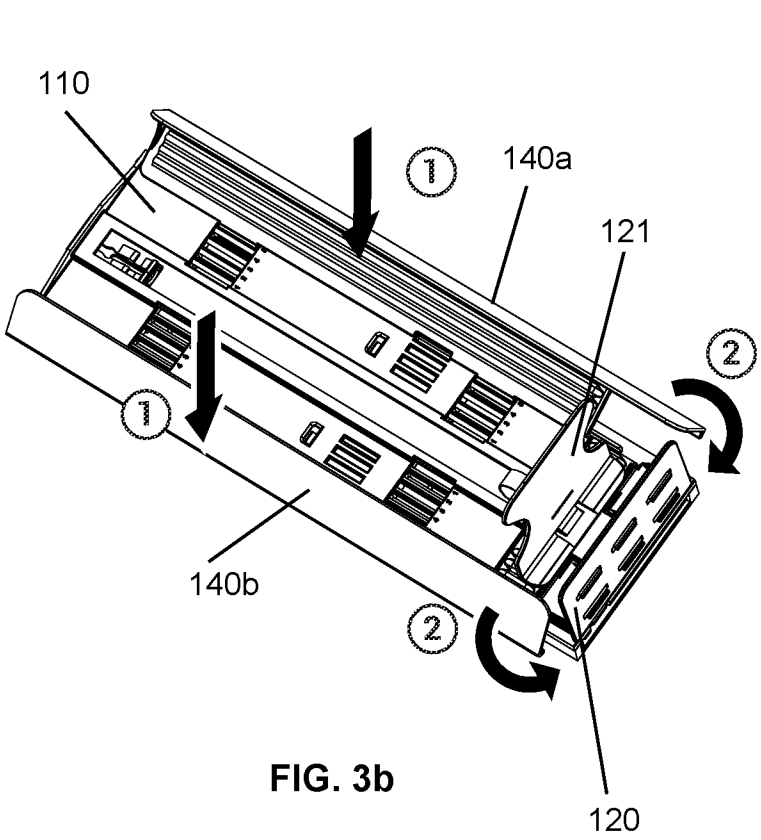
FIGS. 3*a*, 3*b*, 3*c*, 3*d*, 3*e*, and 3*f* illustrate installation and use of an exemplary embodiment of a merchandising tray system.
Figure 3G:
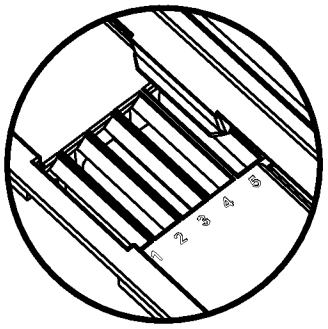
FIG. 3*g* is an enlarged view of a portion of FIG. 3*b*.
Figure 3A:
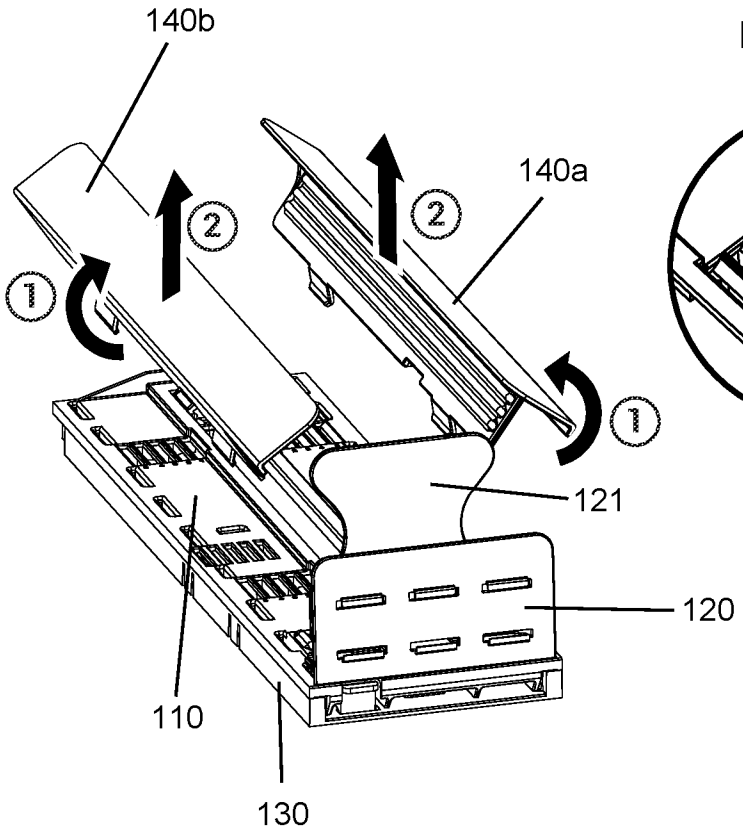
Figure 3H:
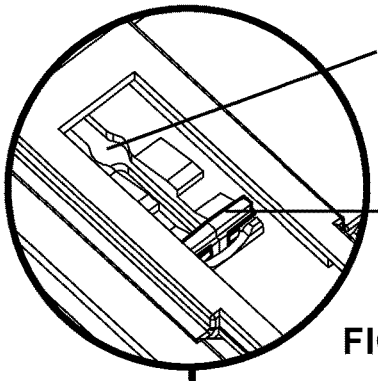
FIGS. 3*h* and 3*i* are enlarged views of a portion of FIG. 3*c*.
Figure 3I:
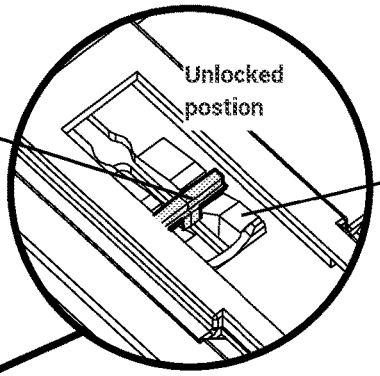
Figure 3C:
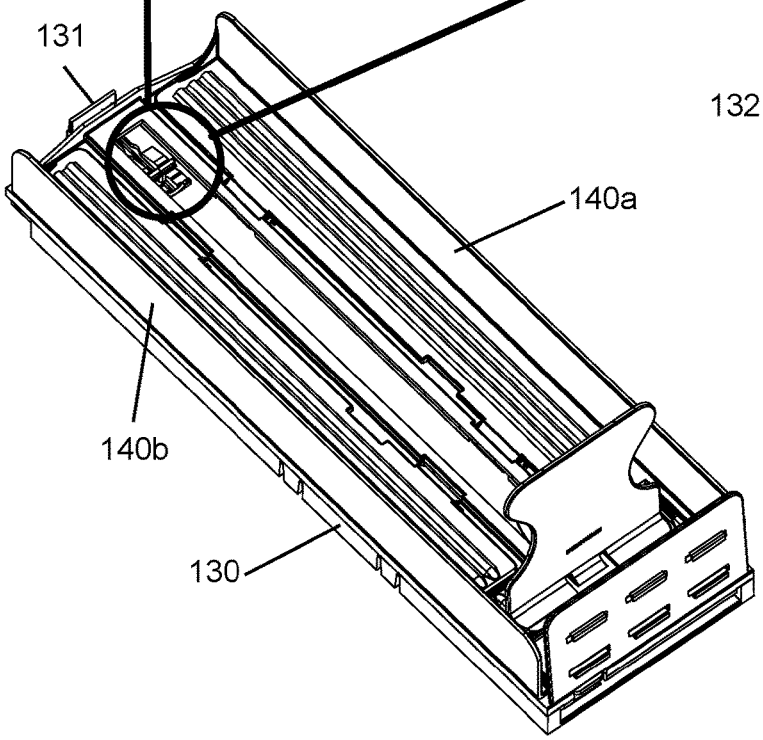
Figure 3D:
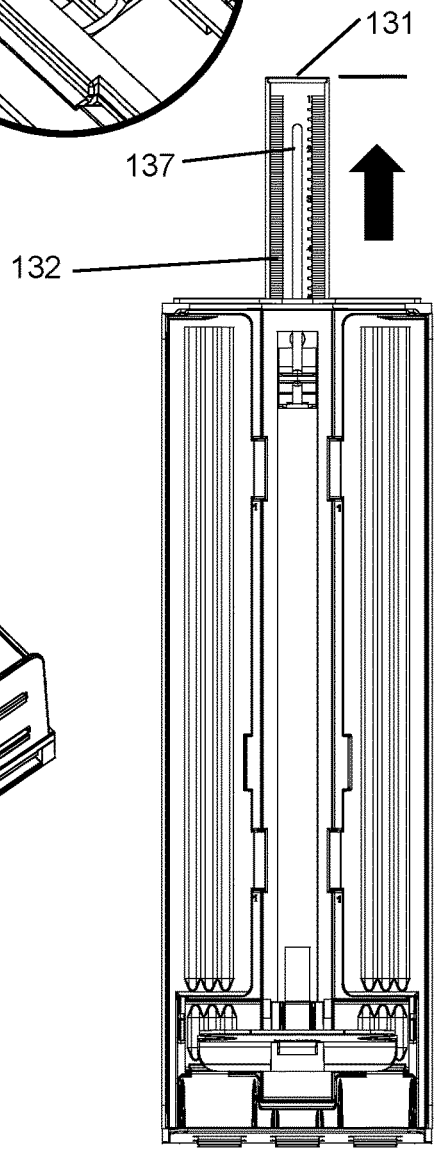
Figure 3E:
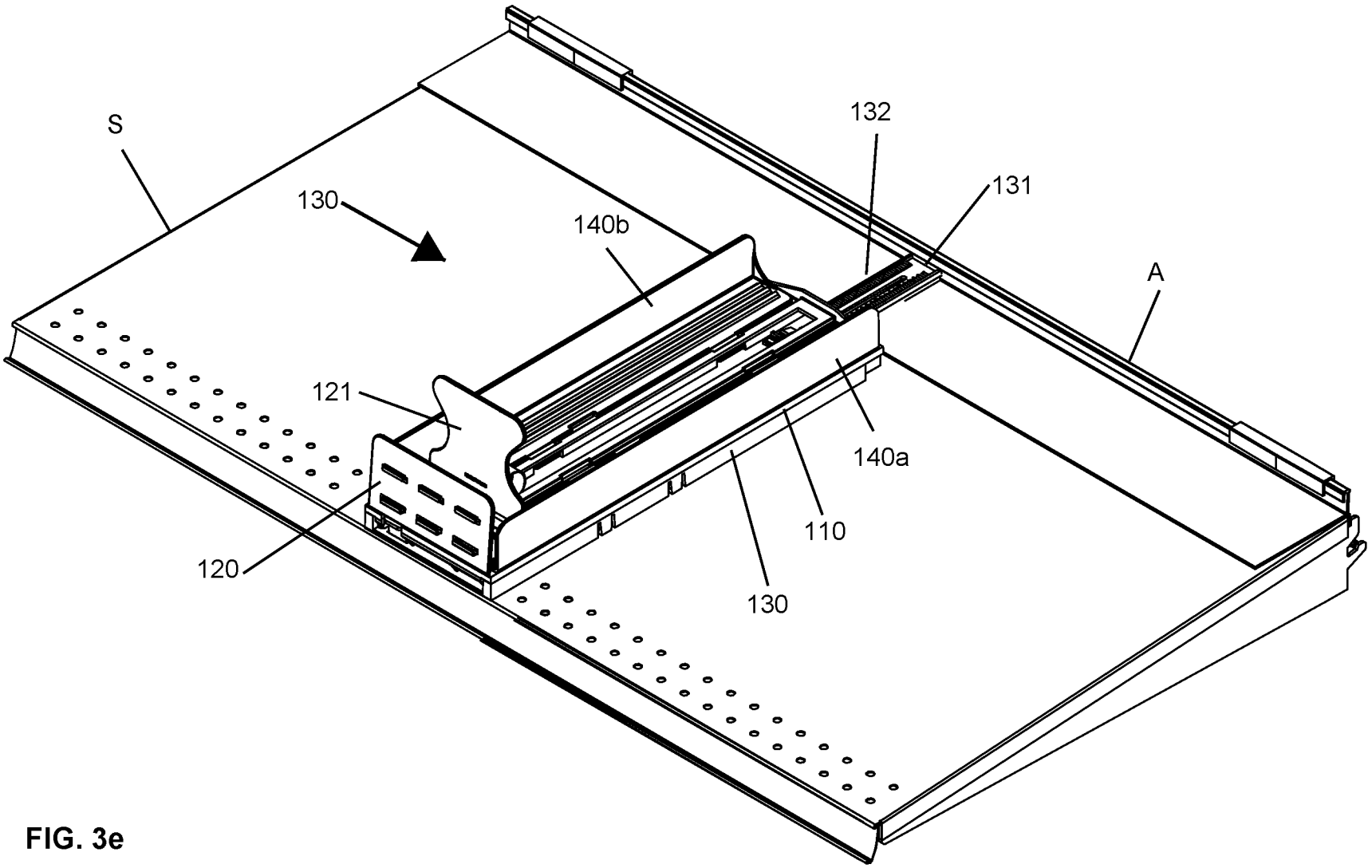
Figures 3F, 3J:
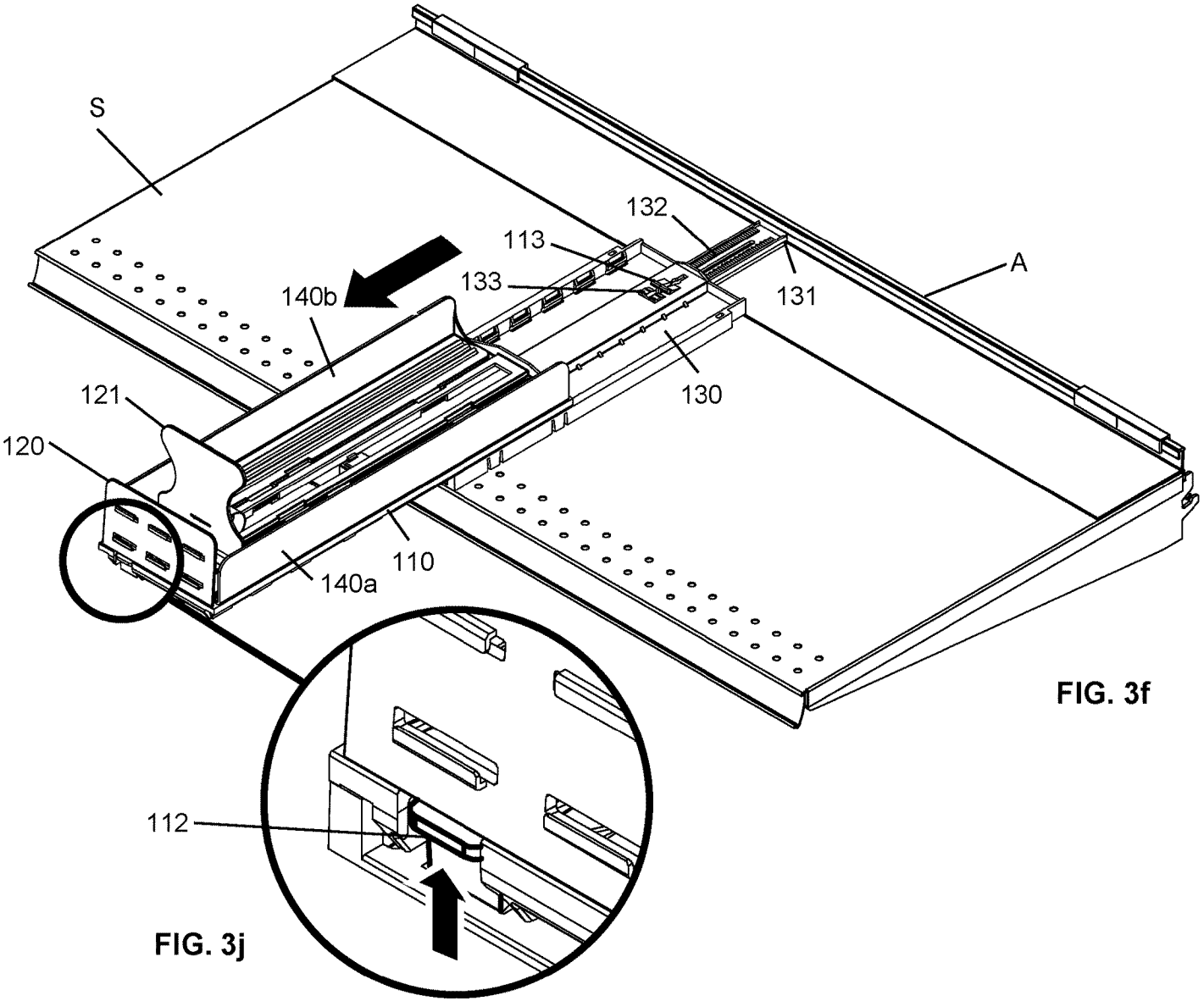
FIG. 3*j* is an enlarged view of a portion of FIG. 3*f*.

In installation and use, as shown in FIGS. 3*a* through 3*j*, the back end of support arm 131 may be anchored to the shelf anchor A before or after the support arm 131 is extended or retracted, depending on the relative sizes of the merchandising tray system 100 and the shelf S. Once the support arm 131 is anchored, as shown in FIG. 3*e*, a user may push the arm lock 113 back, as shown in FIG. 3*i*, unlock the support arm 131, and adjust the positioning of the tray top plate 110 and the tray base plate 130 as needed, as shown in FIG. 3*f*. The user may then push the arm lock 113 forward, as shown in FIG. 3*h*, locking the support arm 131 at a given extension, thereby also locking the positioning of the tray top plate 110 and the tray base plate 130 with respect to the shelf S.

In use, such as, but not limited to, restocking the merchandising tray system 100, the tray lock 112 may be actuated, as shown in FIG. 3*j*, to disengage the tray lock 112 from the tray base plate 130, allowing the tray top plate 110 to slide forward and backward on the tray base plate 130. As shown in FIG. 3*f*, this allows the tray top plate 110 to extend beyond the front of shelf S for merchandising restocking.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

The invention claimed is:

1. A merchandising tray system, the merchandising tray system comprising:

a tray top plate slidably mounted to a tray base plate;

a plurality of sidewalls removably mounted to the tray top plate;

a support arm slidably extendable from the tray base plate; and an arm lock configured to move at least one structure of the tray base plate into an interlocking relationship with a structure of the support arm, such that when the arm lock is actuated, the support arm is locked into position relative to the tray base plate, wherein the arm lock is accessible through an arm lock aperture extending through a top surface of the tray top plate.

2. The system of claim 1, further comprising at least one connecting slot in the tray top plate.

3. The system of claim 2, further comprising at least one connecting tab on at least one sidewall of the plurality of sidewalls, the at least one connecting tab configured to removably interconnect with the at least one connecting slot.

4. The system of claim 1, further comprising a plurality of connecting slots in the tray top plate, the plurality of connecting slots extending laterally and parallel to a centerline of the tray top plate.

5. The system of claim 1, further comprising a tray lock connected to the tray top plate and removably interconnected with the tray base plate.

6. The system of claim 5, wherein actuation of the tray lock disengages the tray lock from the tray base plate, allowing the tray top plate to slide forward and backward on the tray base plate.

7. The system of claim 5, wherein the tray lock is located at a forward surface of the tray top plate.

8. The system of claim 5, wherein the tray lock is biased to return to a locked position when the tray top plate is pushed completely back along tray base plate.

9. The system of claim 1, wherein the support arm is slidably extendable from a rear side of the tray base plate.

10. The system of claim 1, wherein the back end of the support arm is removably connected to a shelf or removably connected to a shelf anchor.

11. The system of claim 1, wherein the arm lock aperture is located adjacent the rear of the tray top plate.

12. A merchandising tray system, the merchandising tray system comprising:

a tray top plate slidably mounted to a tray base plate;

a plurality of sidewalls removably mounted to the tray top plate;

a support arm slidably extendable from the tray base plate; and an arm lock configured to move at least one structure of the tray base plate into an interlocking relationship with a structure of the support arm, such that when the arm lock is actuated, the support arm is locked into position relative to the tray base plate, wherein a plurality of projections interlock with a plurality of apertures, wherein at least one of the plurality of projections and the plurality of apertures are located on an upper surface of the support arm and the other of the plurality of projections and the plurality of apertures are located on the tray base plate.

13. The system of claim 1, wherein when the arm lock is in a locked position, the tray base plate interconnects with the support arm, and the support arm cannot be extended or retracted.

14. The system of claim 1, wherein when the arm lock is in an unlocked position, the tray base plate disengages from the support arm, and the support arm can be extended or retracted from an arm channel.

15. The system of claim 1, wherein pushing the arm lock in a first direction unlocks the support arm and pushing the arm lock in a second direction locks the support arm.

16. The system of claim 12, wherein the arm lock is accessible by extending the tray top plate relative to the tray base plate.

17. A merchandising tray system, the merchandising tray system comprising:

a tray top plate slidably mounted to a tray base plate;

a plurality of sidewalls removably mounted to the tray top plate;

a support arm slidably extendable from the tray base plate; and an arm lock configured to move a plurality of base plate teeth of the tray base plate to mesh with a plurality of support arm teeth located on an upper surface of the support arm, such that when the arm lock is actuated, the support arm is locked into position relative to the tray base plate.

18. A merchandising tray system, the merchandising tray system comprising:

a tray top plate slidably mounted to a tray base plate;

a plurality of sidewalls removably mounted to the tray top plate;

a support arm slidably extendable from the tray base plate; and an arm lock releasably interacting with at least one structure on or in the tray base plate, such that when the arm lock is actuated, the support arm is locked into position relative to the tray base plate, wherein the arm lock is accessible through an arm lock aperture extending through a top surface of the tray top plate.

19. The system of claim 18, wherein the releasable interaction causes at least one structure of the tray base plate to interact with a surface of the support arm in an interlocking fashion, preventing movement of the support arm.

* * * * *